United States Patent [19]

Kolendowicz

[11] 4,088,354

[45] May 9, 1978

[54] DOOR LOCKING MECHANISM FOR SELF-CLEANING OVEN

[75] Inventor: Charles W. Kolendowicz, Buffalo, Minn.

[73] Assignee: Litton Systems, Inc., Beverly Hills, Calif.

[21] Appl. No.: 730,525

[22] Filed: Oct. 7, 1976

[51] Int. Cl.[2] ..... E05C 19/16

[52] U.S. Cl. ..... 292/201; 292/216; 292/DIG. 69

[58] Field of Search ..... 292/201, 216, 78, DIG. 69, 292/341.16

[56] References Cited

U.S. PATENT DOCUMENTS

| | | | |
|---|---|---|---|
| 2,659,782 | 11/1953 | Wolf | 292/DIG. 69 |
| 2,910,317 | 10/1959 | Conlee | 292/DIG. 69 |
| 3,313,918 | 4/1967 | Barber | 282/DIG. 69 |
| 3,543,547 | 12/1970 | Sugiyama | 292/341.16 X |
| 3,917,330 | 11/1975 | Quanty | 292/201 X |

*Primary Examiner*—Richard E. Moore
*Attorney, Agent, or Firm*—Robert E. Lowe

[57] ABSTRACT

A door locking arrangement is disclosed for a domestic cooking range having a pyrolytic self-cleaning mode of operation. The locking mechanism includes a rotatable cam assembly having a cam follower and a detent portion. Closing the oven door causes the cam to rotate whereby the follower engages the door latch. A locking bar engages the detent portion preventing the cam from rotating to the open position, such locking bar being withdrawn upon activation of a solenoid.

6 Claims, 5 Drawing Figures

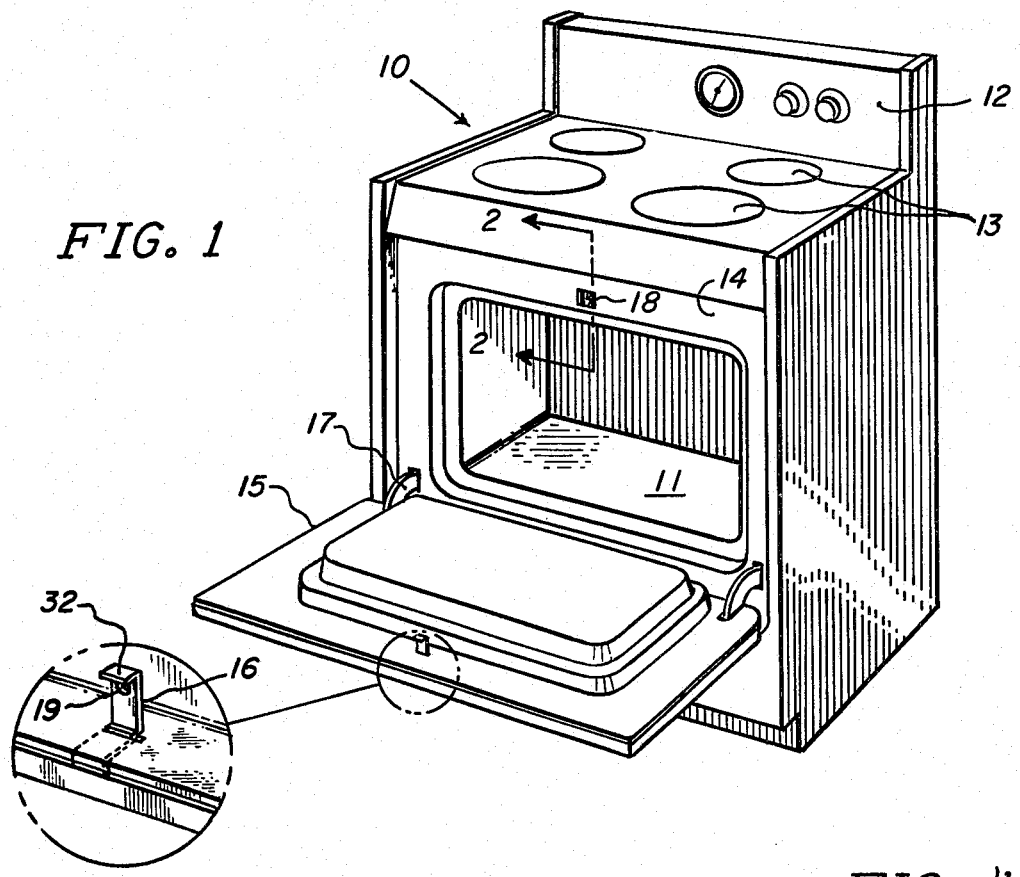
FIG. 1
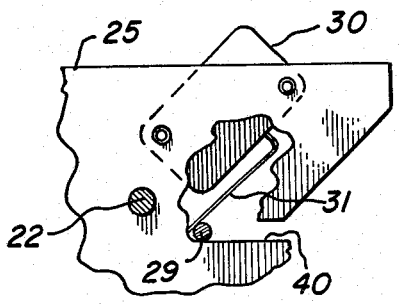
FIG. 5
FIG. 4
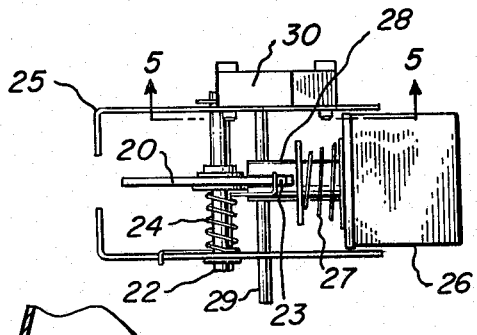
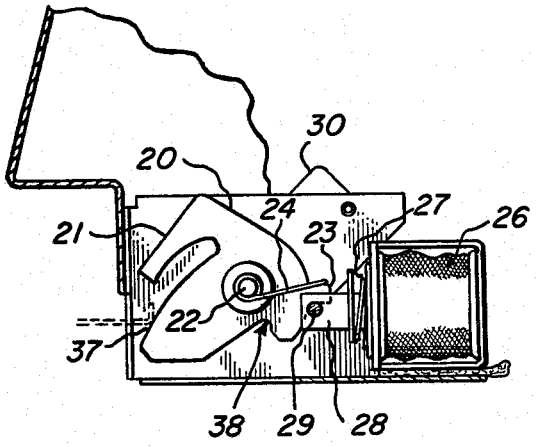
FIG. 2
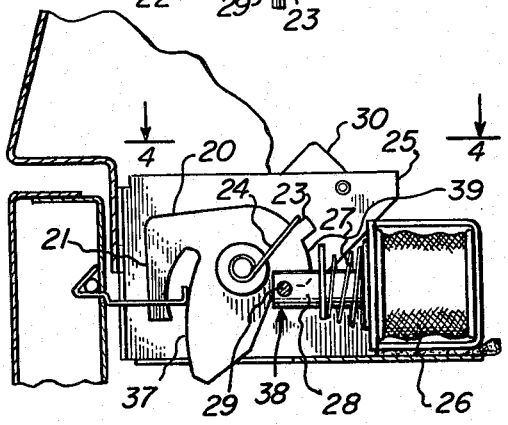
FIG. 3

DOOR LOCKING MECHANISM FOR SELF-CLEANING OVEN

BACKGROUND OF THE INVENTION

This invention relates to the field of domestic cooking ranges, and more particularly to such ranges having a pyrolytic self-cleaning capability. The invention is directed to a door locking mechanism for such appliances for use during the pyrolytic self-cleaning mode of operation.

Domestic ranges having a heat cleaning or a pyrolytic self-cleaning capability are well known. Such ranges use the technique of heating the oven cavity to tempertures substantially in excess of those encountered in normal cooking, typically temperatures above 750° F. Because of the high temperatures involved in the self-cleaning mode, it is advisable that the oven door be securely locked during such operations, and in a manner that will prevent the oven from being openable as long as abnormally high temperatures exist in the oven.

Various mechanisms which have heretofore been suggested to fulfill this function have not been totally satisfactory from the standpoint of ease and cost of manufacture, reliability and ease of operation. A definite requirement remains for a lock mechanism for domestic ranges having a pyrolytic self-cleaning capability which mechanism will exhibit a high degree of reliability, and which in turn can be easily operated by the user of the range.

SUMMARY OF THE INVENTION

It is therefore an object of the present invention to provide a pyrolytic door lock assembly for a domestic cooking appliance which assembly is reliable and simple to manufacture.

A further object of the invention is to provide a lock mechanism for a self-cleaning range which mechanism can be easily and safely operated by the consumer.

The present invention provides a door locking mechanism for a domestic cooking range having a pyrolytic self-cleaning mode of operation. The locking mechanism includes a rotatable cam assembly which includes a cam follower. A latch mechanism mounted on the oven door engages the cam upon closing of the door, causing the cam to rotate to a position whereby the latch is engaged by the cam follower. A locking bar engages a detent portion of the cam, preventing it from being rotated to an unlocked position. The locking bar may be withdrawn upon activation of an unlocking switch as long as the oven temperature is below a predetermined maximum temperature.

DESCRIPTION OF THE DRAWINGS

FIG. 1 is a perspective view of an appliance to which the invention applies having a detailed inset.

FIG. 2 is a partial section view taken along line 2—2 in FIG. 1 showing the mechanism in a first position.

FIG. 3 is a partial section view as in FIG. 2 with the mechanism in a second position.

FIG. 4 is a top plan view of the lock mechanism shown in FIGS. 2 and 3.

FIG. 5 is an enlarged cut-away of the switch portion of the mechanism.

DESCRIPTION OF PREFERRED EMBODIMENTS

In the drawings FIG. 1 depicts a domestic cooking appliance 10 of the type to which the invention is generally applicable. The range 10 includes an oven cavity 11, a control panel 12 and conventional surface elements 13. A door 15 is mounted to the range by means of hinges 17.

Mounted to the central portion of the interior face of door 15 is a door latch 16. The door latch 16 is rotatably mounted to the door in such a fashion that in a first position it is closed snugly against the interior of the door while in a second position it is opened to project from the interior surface of the door 15 in an approximately perpendicular position. When the door latch 16 is in its opened or operating position and the door 15 is closed against the front panel 14 of the range 10, the door latch 16 is received by the latch recess 18 located in the front panel 14. The lock mechanism described in more detail hereinafter is mounted to the range 10 in an area immediately behind latch recess 18 where it may be engaged by door latch 16.

The locking mechanism of the present invention is shown in detail in FIGS. 2 and 3. As shown therein, the mechanism includes a mounting bracket 25 in which the remaining components of the lock mechanism are mounted to form a unitary assembly. Supported in the bracket 25 is a shaft 22 upon which is mounted a cam assembly 20 and a return spring 24. The cam assembly 20 is uniquely configured to include a cam surface 37, a cam follower 21, a cam stop 23 and a detent portion 38.

The entire cam assembly 20 is rotatable about shaft 22. The return spring 24 is attached to the cam assembly 20 in a manner such that the spring is loaded upon rotation of the cam assembly in a counter clockwise direction as viewed in the drawings. In other words, the return spring 24 is loaded upon the rotation of the cam follower 21 in a downward direction.

A solenoid 26 is attached to the bracket 24 rearwardly of the cam assembly 20 as viewed from the front of the range 10. A U-shaped arm 28 is attached to the operating shaft of the solenoid and a locking bar 29 is attached to the U-shaped arm 28. Slots 40 are provided in the mounting bracket 25 to allow for the reciprocating movement of locking bar 29 forwardly and rearwardly with the operation of the solenoid 26.

A switch 30 is mounted to one side of the bracket 25, the switch having an actuating arm 31 extending downwardly therefrom. The switch 30 may be wired into the operating circuit of the range 10 in a manner to provide an electrical signal indicating that the door lock assembly is in the locked position in order to control the operation of a pyrolytic self-cleaning cycle in the range.

In order to operate the lock mechanism of the present invention to prepare the range 10 for a pyrolytic self-cleaning cycle, the door latch 16 is first manually rotated to its open or operating position, namely that position in which it extends perpendicularly from the inside face of the door 15. As the door 15 is then closed the latch 16 extends through latch recess 18. The nose portion 32 of the door latch 16 engages the cam surface 37 of cam assembly 20. The action of the nose portion 32 on the cam surface 37 causes the cam assembly 20 to rotate in a counter clockwise direction as viewed in the drawings, rotating cam follower 21 in a downward direction. The cam follower 21 passes through the latch aperture 19 thereby holding the latch 16 in position and preventing the door 15 from being pulled open.

The locking bar 29 is normally urged forwardly by the action of solenoid spring 27, the locking bar 29 contacting and riding upon the rear cam surface 39 of cam assembly 20. As the cam assembly 20 is rotated by action of the door latch 16, the locking bar 29 comes to the end of its travel along rear cam surface 39 and snaps into the detent portion 38 of the cam assembly. At this point the cam assembly 20 is in its fully down and locked position. The locking bar 29 having passed into the detent portion 38 prevents the cam assembly 20 from being rotated in a clockwise direction as viewed in the drawing and thus the range door 15 can no longer be pulled open. At the same time, the locking bar 29 engages the actuating arm 31 of switch 30 causing the switch to be closed to generate an electricl signal that the door is in the locked position, which signal may be used to complete a pyrolytic self-cleaning power circuit.

In order to unlock the oven door a push button switch located on the control panel 12 of the range is operated closing a circuit which provides power to the solenoid 26. Upon energization of the solenoid 26 the solenoid operating shaft and arm 28 and locking bar 29 are pulled rearwardly toward the solenoid coil. As the locking bar 29 passes out of the detent portion 38 the cam assembly 20 is free to rotate in a clockwise direction as viewed in the drawings under the force of the return spring 24 which had been loaded during the locking operation as previously described. The rotation of the cam assembly 20 in such direction rotates the cam follower 21 upwardly out of the latch aperture 19 of door latch 16. After a sufficient degree of rotation has taken place to allow the door latch 16 to be freed, the cam stop 23 abuts against locking bar 29 to limit the travel of cam assembly 20 in the clockwise direction.

The operating switch for solenoid 26 is preferably of the momentary type so that when it is released power to solenoid 26 is terminated allowing the solenoid operating arm 28 and locking bar 29 to again move forwardly under the force of the solenoid spring 27 whereby the locking bar 29 once again comes to rest against the rear cam surface 39 of cam assembly 20.

If preferred the oven operating circuit may include an additional thermostatic switch adapted to open whenever the oven temperature is above a preselected maximum, for example, 560 degrees F. The operation of such a thermostatic switch would then interrupt the circuit between the solenoid 26 and its operating switch so that the solenoid 26 could not be energized so long as the temperature in the oven remained above the preset maximum. In this way opening of the oven above the selected maximum temperature is prevented and circuitry to accomplish that purpose is well known in the art.

For normal cooking operations in the range the door latch 16 is rotated to its closed position abutting the interior surface of the door 15. In such position the door latch 16 does not extend into the latch recess 18 and the lock mechanism is accordingly not engaged. In such configuration the conventional cooking operations such as baking and broiling may be carried out within the oven, however, a pyrolytic self-cleaning mode of operation could not be carried out because switch 30 would be open indicating that the door was not in a securely locked configuration.

The lock assembly thus described provides a very simple and reliable method for locking an oven door during a pyrolytic self-cleaning operation. The provision of the cam assembly reduces the number of parts required to a minimum and allows the door to be safely locked by merely rotating the door latch into its operating position and closing the door. The lock assembly does not depend upon any electrically energized parts in order to accomplish a safely locked configuration, but rather it uses power to perform only the unlocking sequence.

While in the foregoing specification the invention has been described in considerable detail it will be appreciated that such detail is for the purpose of illustration and that many additional modifications may be made by those skilled in the art without departing from the spirit or scope of the invention, which is intended to be limited only by the scope of the appended claims.

I claim:

1. In a domestic cooking appliance of the type including an oven, an oven door hingedly mounted on said appliance, and wherein said appliance includes a mode of operation for accomplishing self-cleaning of said oven by pyrolysis, the improvement comprising:

door latch means selectively moveable between a first storage position and a second operating position and including an aperture, door locking means for engaging said latch means when said latch means is in said second operating position and said door is closed, said lock means including a rotatable cam assembly having a cam follower, said latch means adapted to engage and rotate said cam assembly upon closing of said door when said latch means is in said second operating position causing said cam follower to pass through said aperture in said latch means to hold said door closed, whereby said lock means is not engaged when said door is closed with said door latch means in its first storage position.

2. The apparatus of claim 1 further comprising locking bar means engageable with said cam assembly to prevent the disengagement of said cam assembly and said latch means.

3. The apparatus of claim 2 further comprising means for disengaging said locking bar means.

4. The apparatus of claim 2 further comprising means providing an electrical indication of a locked condition of said locking means, said indicating means being activated by said locking bar means.

5. The apparatus of claim 3 wherein said disengaging means includes a solenoid whereby said locking bar means is disengaged upon activation of said solenoid.

6. The apparatus of claim 3 further comprising spring means acting upon said cam assembly to return said assembly to a disengaged position upon release of said locking bar means.

* * * * *